US006829542B1

(12) United States Patent
Reynolds et al.

(10) Patent No.: US 6,829,542 B1
(45) Date of Patent: Dec. 7, 2004

(54) PUMP AND METHOD FOR FACILITATING MAINTENANCE AND ADJUSTING OPERATION OF SAID PUMP

(75) Inventors: Steven M. Reynolds, Lucas, OH (US); Raymond J. Niemczura, Sr., Mansfield, OH (US); David E. Roseberry, Bellville, OH (US); Michael D. Hennessey, Lexington, OH (US)

(73) Assignee: Warren Rupp, Inc., Mansfield, OH (US)

( * ) Notice: Subject to any disclaimer, the term of this patent is extended or adjusted under 35 U.S.C. 154(b) by 429 days.

(21) Appl. No.: 09/584,570

(22) Filed: May 31, 2000

(51) Int. Cl.[7] ..... G01F 1/34
(52) U.S. Cl. ..... 702/34
(58) Field of Search ..... 702/34, 113, 184; 73/864, 863, 861, 863.03, 861.42, 168; 175/73, 19, 48, 45; 342/83; 600/595; 436/139; 307/118; 700/108, 65, 282; 701/33; 714/47; 241/36; 340/680; 318/85; 367/69; 356/477

(56) References Cited

U.S. PATENT DOCUMENTS

| | | | | |
|---|---|---|---|---|
| 4,951,271 A | * | 8/1990 | Garrett et al. | 367/141 |
| 5,237,539 A | * | 8/1993 | Selman | 367/69 |
| 5,265,431 A | | 11/1993 | Gaudet et al. | |
| 5,563,351 A | * | 10/1996 | Miller | 73/861.42 |
| 5,628,229 A | * | 5/1997 | Krone et al. | 73/168 |
| 5,742,500 A | | 4/1998 | Irvin | |
| 5,767,635 A | * | 6/1998 | Steffens et al. | 318/85 |
| 5,996,422 A | * | 12/1999 | Buck et al. | 73/863.03 |
| 6,192,299 B1 | * | 2/2001 | Kubota et al. | 700/282 |
| 6,434,512 B1 | * | 8/2002 | Discenzo | 702/184 |

FOREIGN PATENT DOCUMENTS

| | | |
|---|---|---|
| DE | 198 29 084 A1 | 1/2000 |
| WO | WO-00/29749 | 5/2000 |

OTHER PUBLICATIONS

Internet article, *Flow Focus*, Sep. Issue (one page).
Internet article, *Pump Smart*, Goulds Pumps, ITT Industries (one page).
Internet article, *Plug and Pump*, Vindum Engineering, Incorporated (one page).

* cited by examiner

*Primary Examiner*—John Barlow
*Assistant Examiner*—Tung Lau
(74) *Attorney, Agent, or Firm*—Barnes & Thornburg LLP

(57) ABSTRACT

A method of facilitating the maintenance of a pump and for facilitating changes in the operation of a pump is provided. The method includes the steps of providing a pump including wear parts, a processor and a memory; sensing at least one operating condition of the pump indicative of the operation of the pump; generating pump operational data reflective of the sensed operating condition; storing the generated operational data in the memory of the processor; storing parts identification data identifying wear parts of the pump in the memory; storing at least one predetermined level of operational information; and operating the processor to compare the stored predetermined level to the stored operational data and in dependent response thereto outputting information as to the desirability of replacing or repairing at least one selected wear part or modifying the operation of the pump. An improved pump with numerous sensors for sensing operational data relative to the wear and tear of various parts of the pump and the operating parameters of the pump which are linked to a processor mounted at the pump and which, in turn, is linked to a main computer is also disclosed.

44 Claims, 5 Drawing Sheets

PUMP AND METHOD FOR FACILITATING MAINTENANCE AND ADJUSTING OPERATION OF SAID PUMP

FIELD OF THE INVENTION

The present invention relates generally to pumps and the maintenance and operation thereof. More specifically, the present invention relates to a method of facilitating the maintenance of a pump utilizing characteristic "signatures" of a pump such as the acoustic sounds the pump makes during operation, the vibrations generated by the pump or other signals unique to the pump. The present invention also utilizes a processor and one or more sensors that provide information about the pump during the operation thereof. The information provided by the sensor is utilized by the processor to determine whether the replacement or repair of a wear part is indicated or whether the operation of the pump should be modified for efficiency, safety or other reasons.

BACKGROUND OF THE INVENTION

The control and operation of pumps by electronic means is known only to the extent that electronic means such as computers or processors have been used to start, stop and control the rate at which pumps operate. However, pumps typically perform essential functions in industrial processes such as delivering material from one point to another. When one pump in a large complex operation fails due to need of repair or other reason, the entire process can be jeopardized and may often need to be shut down. Thus, not only is it important to keep a pump that forms a part of a complex operation running, it is important to know when the pump will need servicing so that the replacement or repair of the wear parts of the pump can be scheduled for a convenient time, i.e. during a planned shutdown of the operation. Still further, it is important for the operator to know whether a pump is operating efficiently so that energy consumption can be minimized and the useful life of the wear parts of the pump can be maximized. In these regards, the use of processors and electronic circuitry to provide the operator of advance notice of needed repairs or with information concerning the efficiency and operational characteristics of pumps has not been provided.

For example, the present invention was developed in the context of an air operated double diaphragm pump. However, upon review of this specification, it will be readily apparent to the reader that the present invention is not limited to such pumps. In the context of diaphragm pumps, it would be extremely useful to utilize data measurement regarding the diaphragm physical integrity during the operation of the pump. Such a measurement could be used to alert the operator of imminent diaphragm failure or an automatic shutdown of the pump prior to diaphragm failure if corrective action has not been taken within an allotted time interval. Such a data measurement and warning system would provide serious environmental safety benefits and reduce the frequency of spillage because when a diaphragm fails in a diaphragm pump, the material being pumped will spill through a broken diaphragm.

Similarly, double diaphragm pumps have two pumping chambers, each partially bound with a diaphragm. The diaphragms are connected by a common diaphragm rod. While material is being pumped out of one chamber, material is being drawn into the other chamber. Each chamber is also bound by two check valves. The check valves disposed at the bottom of the two chambers permit the drawing of fluid into their respective chambers and then are sealed to prevent any fluid from passing through the valve when the fluid is being pumped out of the chamber. Similarly, the two check valves typically disposed at the top of the chambers are in a sealing position when fluid is being drawn into the chamber but permit fluid to flow out of the chamber during a pump stroke. Currently, there is no means for detecting fluid "slip" between the check valve and seat. The detection of such a condition could be used to alert the operator that maintenance is required or simply to alert the operator that the speed of the pump needs to be adjusted.

As another example, data regarding the back pressure in the air chamber behind each diaphragm would be important to determine whether any excessive exhaust restrictions exist such as icing of the muffler or freezing of wet air in the exhaust port. Similarly, a measurement of the filling rate of each pump chamber could be used to regulate the speed of the pump and therefore energy consumption to optimize efficiency. In addition to energy savings, optimizing the efficiency of a pump can also optimize the useful life of the diaphragm, check valve components and other wear parts thereby reducing operating costs.

Further, a measurement of the diaphragm temperature during operation of the pump could be used to ensure safe operation of the pump taking into consideration the defined temperature limits of the diaphragm material. Measurement of the suction pressure could also be used to ensure safe operation of the pump. A detection of any parameter outside of a predetermined safe parameter range could be used to alert the operator or automatically shut down the pump.

Accordingly, there is a need for the use of electronic means to monitor various parameters of a pump during the operation thereof to not only facilitate the maintenance of the pump but also adjust the operation of the pump for safety as well as efficiency reasons.

SUMMARY OF THE INVENTION

The present invention satisfies the aforenoted needs by providing a method of facilitating the maintenance or modifying the operation of a pump and a pump equipped with a processor and memory thereby facilitating maintenance and operating decisions.

In an embodiment, the present invention provides a method of facilitating maintenance of a pump comprising the following steps: providing a pump including wear parts, a processor and memory; sensing at least one operating condition of the pump indicative of the operation of the pump; generating operational data reflective of the sensed operating condition; storing the generated operational data in the memory; storing parts identification data identifying wear parts of the pump in the memory; storing at least one predetermined level of operational information; and operating the processor to compare the stored predetermined level to the stored operational data and in dependent response thereto outputting information as to the desirability of replacing or repairing at least one selected wear part.

In an embodiment, the method further comprises the following step: repeating the steps of sensing at least one operating condition of the pump indicative of the operation of the pump, generating operational data reflective of the sensed operating condition, storing the operational data in the memory, and thereafter updating the stored operational data in dependent response to the sensing of the at least one operating condition.

In an embodiment the method further comprises the following steps: retrieving parts identification data for the at least one selected part from the memory, and outputting information identifying the at least one part whose replacement or repair is desired.

In an embodiment, the pump comprises a pumping element and the operational condition of the sensing step is a physical integrity of the pumping element of the pump.

In an embodiment, the pumping element is a diaphragm.

In an embodiment, the pump comprises a check valve and the operational condition of the sensing step is a reverse fluid flow through the check valve.

In an embodiment, the method further comprises the following step: providing at least one sensor.

In an embodiment, the present invention provides a method of modifying an operation of a pump comprising the following steps: providing a pump, a processor and memory; sensing at least one operating condition of the pump indicative of the operation of the pump; generating operational data reflective of the sensed operating condition; storing the generated operational data in the memory; storing at least one predetermined level of operational information; operating the processor to compare the stored predetermined level to the stored operational data and in dependent response thereto outputting information as to the desirability of modifying the operation of pump.

In an embodiment, the method further comprises the following step: repeating the steps of sensing at least one operating condition of the pump indicative of the operation of the pump, generating operational data reflective of the sensed operating condition, storing the operational data in the memory, and thereafter updating the stored operational data in dependent response to the sensing of the at least one operating condition.

In an embodiment, the operational condition of the sensing step is an output flow rate of the pump.

In an embodiment, the operational condition of the sensing step is a cycle rate of the pump.

In an embodiment, the operational condition of the sensing step is an acceleration of a cycle rate of the pump.

In an embodiment, the pump comprises a pumping element and the operational condition of the sensing step is a temperature of the pumping element of the pump.

In an embodiment, the pumping element is a diaphragm.

In an embodiment, the pump is an air operated diaphragm pump comprising an air chamber and the operational condition of the sensing step is a back pressure in the air chamber.

In an embodiment, the pump comprises at least one pumping chamber and the operational condition of the sensing step is a filling rate of the pumping chamber.

In an embodiment, the operational condition of the sensing step is a suction pressure of the pump.

In an embodiment, the present invention provides a pump that comprises at least one wear part, a processor and memory, at least one sensor for sensing at least one operating condition of the pump, and a display. The sensor communicates operational data reflective of the sensed operating condition to the processor. The processor stores the operational data in the memory and updates the stored operational data upon receipt of new operational data from the sensor. The memory also comprises parts identification data that identifies wear parts of the pump and at least one predetermined level of operational information. The processor compares the stored predetermined level to the stored operational data and, in dependent response thereto, outputs information to the display as to the desirability of replacing or repairing at least one selected wear part. In such an embodiment, the parts identification data of the memory is essentially a listing of the parts that are subject to wear. In such an embodiment, the memory may also include data equivalent to an operating manual, parts lists and drawings illustrating the operation of the pump.

In an embodiment, the processor is in communication with a stand alone computer.

In an embodiment, the computer is a hand held computer.

In an embodiment, the processor of the pump is linked to at least one other processor of another pump.

In an embodiment, the wear part is a pumping element.

In an embodiment, the pumping element is a diaphragm.

In an embodiment, the wear part is a check valve and the sensor senses a reverse fluid flow through the check valve.

In an embodiment, the processor further compares the stored predetermined level to the stored operational data and in dependent response thereto outputs information as to the desirability of modifying the operation of pump.

In an embodiment, the present invention provides a pump that comprises at least one wear part, a processor and memory, at least one sensor for sensing at least one operating condition of the pump, and a display, the sensor communicating operational data reflective of the sensed operating condition to the processor, the processor storing the operational data in the memory and updating the stored operational data upon receipt of new operational data from the sensor, the memory also comprising parts identification data identifying wear parts of the pump and at least one predetermined level of operational information, the processor comparing the stored predetermined level to the stored operational data and in dependent response thereto outputting information to the display as to the desirability of replacing or repairing at least one selected wear part.

In an embodiment, the sensor is a flow meter and operational condition sensed by the sensor is an output flow rate of the pump.

In an embodiment, the sensor comprises at least one proximity switch and operational condition sensed by the sensor is a cycle rate of the pump.

In an embodiment, the operational data communicated by the sensor to the processor is a change in the cycle rate of the pump.

In an embodiment, the operational data communicated by the sensor to the processor is a temperature of the pumped fluid.

In an embodiment, the pump is an air operated diaphragm pump comprising an air chamber and the operational condition sensed by the sensor is a back pressure in the air chamber.

In an embodiment, the pump comprises at least one pumping chamber and the operational condition sensed by the sensor is a filling rate of the pumping chamber.

In an embodiment, the operational condition sensed by the sensor is a suction pressure of the pump.

In an embodiment, the processor compares the stored predetermined level to the stored operational data and in dependent response thereto outputting information to the display as to the desirability of replacing or repairing at least one selected wear part.

In yet another embodiment, the present invention utilizes signature signals of a pump, such as acoustic signature of a pump or the sounds the pump makes during operation thereof, a vibration signature of the pump or the vibrations made by the pump during operation thereof or other unique signatures in the form of signals emitted by the pump during operation of the pump. The present invention provides a means for utilizing these signatures, detecting changes therein and then determining the need for part replacement or maintenance of the pump.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and tables and described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
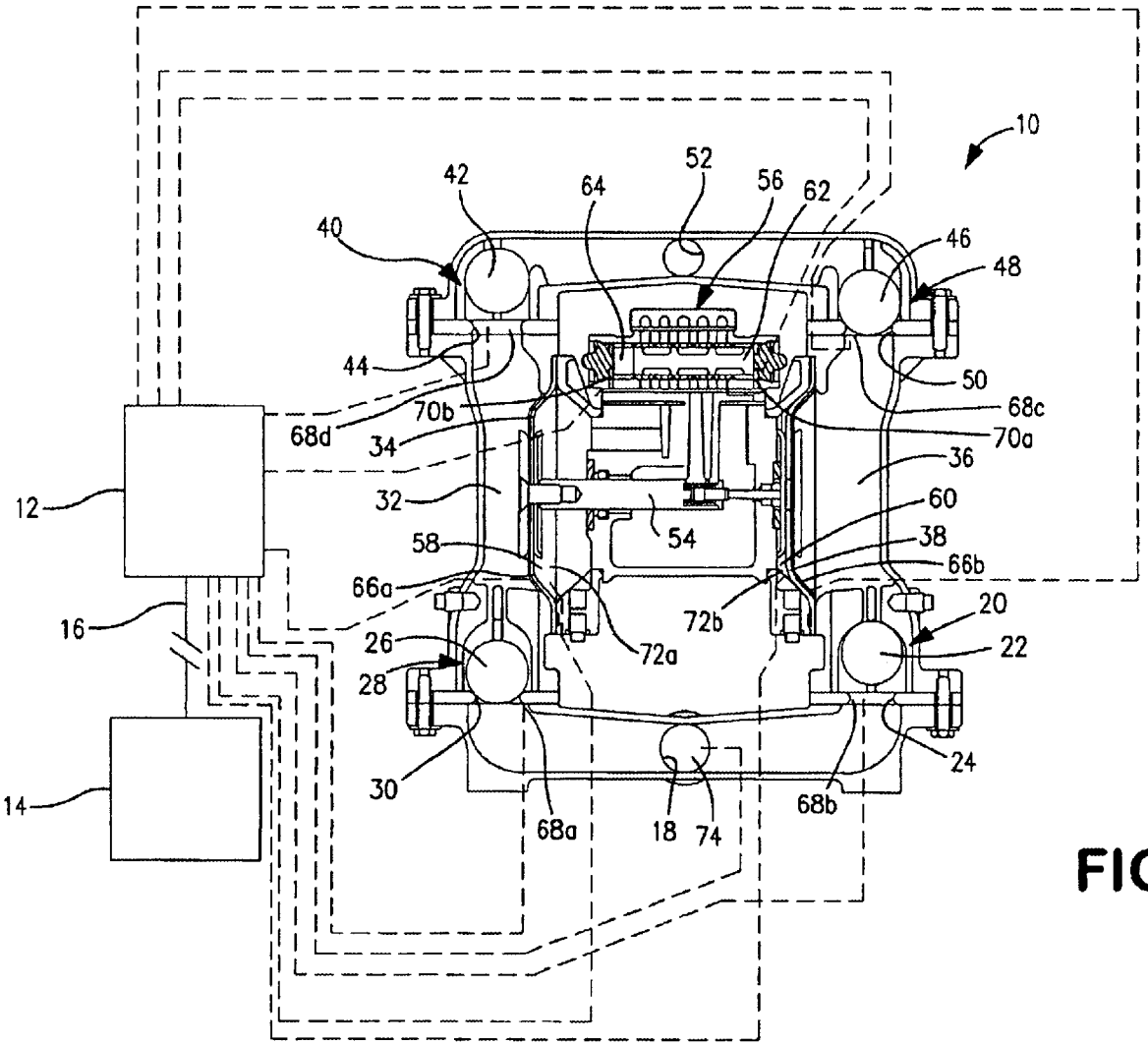
FIG. 1 is a schematic illustration of an air operated double diaphragm pump equipped with a microprocessor and sensors in accordance with the present invention.

FIG. 1 schematically illustrates a pump 10 equipped with a plurality of sensors as well as a microprocessor 12. The microprocessor 12 is shown linked to a central computer 14 by a transmission means 16 such as a serial interface, local area network server (LAN), databus, modem or the like.

Referring back to the pump 10, it should be noted that the pump 10 is an air operated double diaphragm pump (AODD) but it will also be noted that the present invention and the concepts provided by the present invention are also applicable to other pumps as well. That is, the present invention is not limited to diaphragm pumps. In general, the pump 10 includes an intake port 18 through which fluid is drawn. In the position illustrated in FIG. 1, the fluid flows through the intake port 18 and past the check valve 20 (note that the ball 22 is lifted off of the seat 24 by the force of the flowing fluid). In contrast, the ball 26 of the check valve 28 is firmly planted on the seat 30 as fluid is pumped out of the chamber 32 by the force exerted on the fluid in the chamber 32 by the diaphragm 34 which has been moved to the left in a displacement stroke. In contrast, fluid is being drawn into the chamber 36 because the diaphragm 38 has been moved to the left in a suction stroke. The fluid being pumped out of the chamber 32 flows through the check valve 40 as it lifts the ball 42 off of the seat 44. In contrast, the low pressure environment created in the chamber 36 by the movement of the diaphragm 38 to the left causes the ball 46 of the check valve 48 to be suctioned downward on its seat 50. Fluid exits the pump through the outlet port 52.

The diaphragms 34, 38 are connected to one another by a diaphragm rod 54. Power is supplied to the pump by way of air transmitted through a main air valve 56 to one of two air chambers 58, 60 to move the diaphragms back and forth. It will be noted that the main air valve 56 includes a spool 62 that moves back and forth within the chamber shown at 64. However, a detailed explanation of the workings of the air valve is not necessary as air valves for these types of pumps are well known to those skilled in the art.

In order to better monitor the pump 10 and keep the operators apprised of when repairs or maintenance may be needed and to further keep the operators apprised of the operating efficiency of the pump, a number of sensors can be employed and linked to the processor 12 to provide valuable information to the operators. Specifically, diaphragm monitoring sensors 66*a*, 66*b* may be employed on one or both diaphragms and linked to the processor 12. Further, the sensors 66*a*, 66*b* may also provide temperature information regarding the temperature of the diaphragms 34, 38. Such temperature data can be used to ensure safe operation of the pump within the defined temperature limits of the diaphragm material. Indication that the temperature of the diaphragms 34, 38 falls outside of the desired or recommended temperature range can result in an alarm or an automatic shut down of the pump. These sensors would generate a signal or pulse when the integrity of the diaphragm is compromised or in danger of imminent failure. One embodiment of such a diaphragm sensor is an acoustic sensor that detects the acoustic signature of a healthy or viable diaphragm and therefore is capable of detecting changes in the acoustic signature of the diaphragm indicating wear and tear or damage. Further, flow sensors such as those shown at 68*a*–68*d* disposed upstream of each check valve 28, 20, 48, 40 could detect leakage or fluid slip behind the check valves 28, 20, 48, 40 when the valves are supposed to be in a sealing position. These sensors could also be linked to the processor 12 so that the processor 12 could alert the operator to a slip condition and the need for corrective maintenance. Further, the operator may decide that it is necessary to adjust the speed of the pump to resolve such a fluid slip problem. Further, the sensors 68*a*, 68*b*, where sensors disposed in or slightly downstream of the check valves 28, 20 could be used to monitor the filling rate of the pump chambers 32, 36. Data generated by the sensors 68*a*, 68*b* could be used to monitor energy consumption and optimize efficiency.

To sense the speed of the pump, a proximity sensor 70*a*, 70*b* may be disposed on either end of the chamber 64 of the main air valve 56 to detect when the spool 62, and therefore the diaphragm rod 54, is at an end of stroke. The proximity sensors 70*a*, 70*b* would, of course, also be linked to the processor 12.

Further, it may be desirable to include pressure sensors 72*a*, 72*b* in the air chambers 58, 60 to monitor the back pressure in these chambers 58, 60. This back pressure data can be used to determine if any excessive exhaust restrictions exist such as icing of the muffler or freezing of wet air in the port. The processor 12 can then alert the operator of the condition and possibly schedule corrective maintenance action.

A sensor 74 may be disposed in the intake port 18 to measure suction pressure to ensure safe operation of the pump 10 within the recommended operating parameters.

Figure 3:
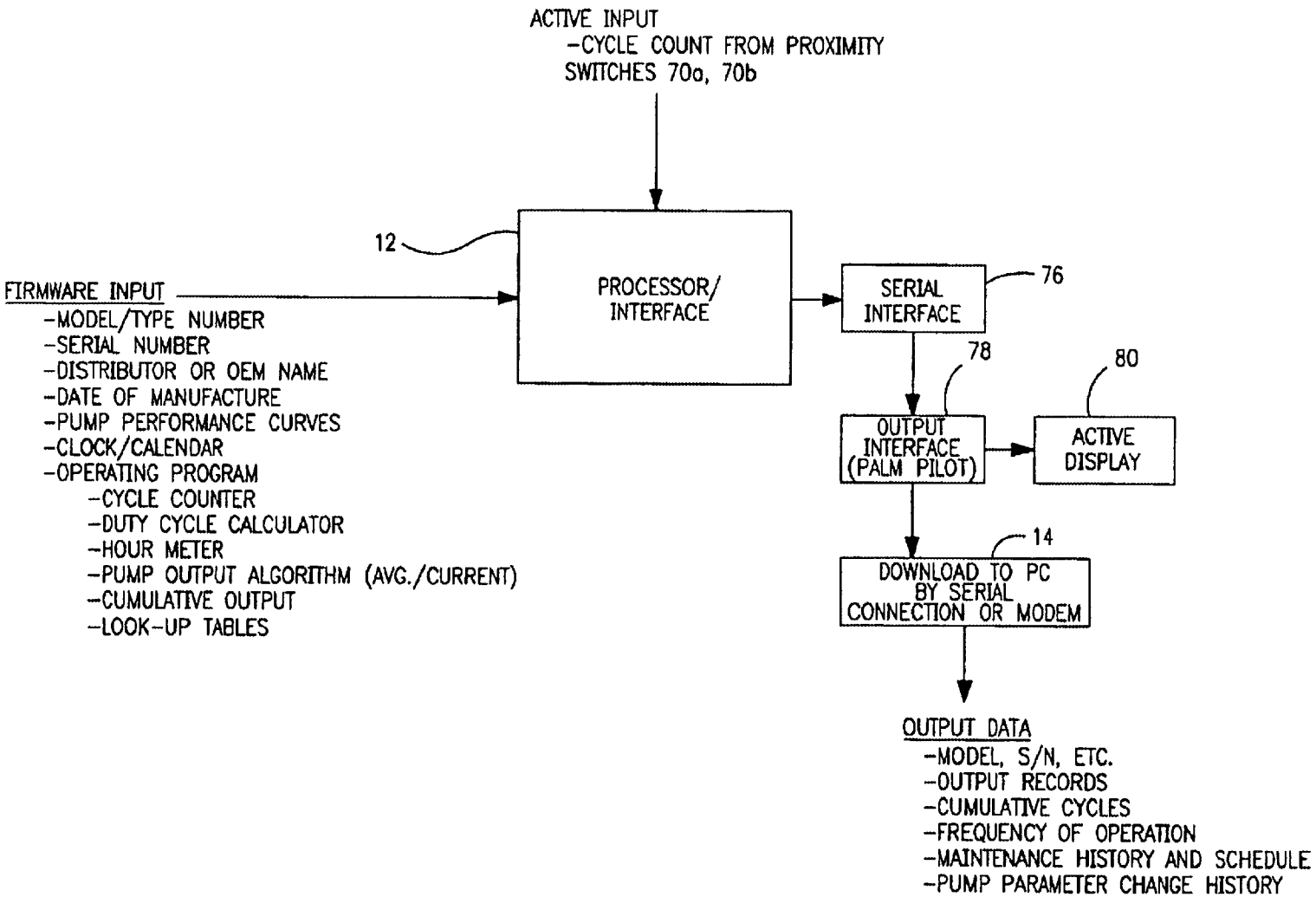
FIG. 3 is a schematic flow diagram illustrating the data communicated to a processor incorporated into a pump equipped with the present invention during operation of the pump as well as initial firm ware input and the communication of data from said processor to an active display or central computer.
Figure 4:
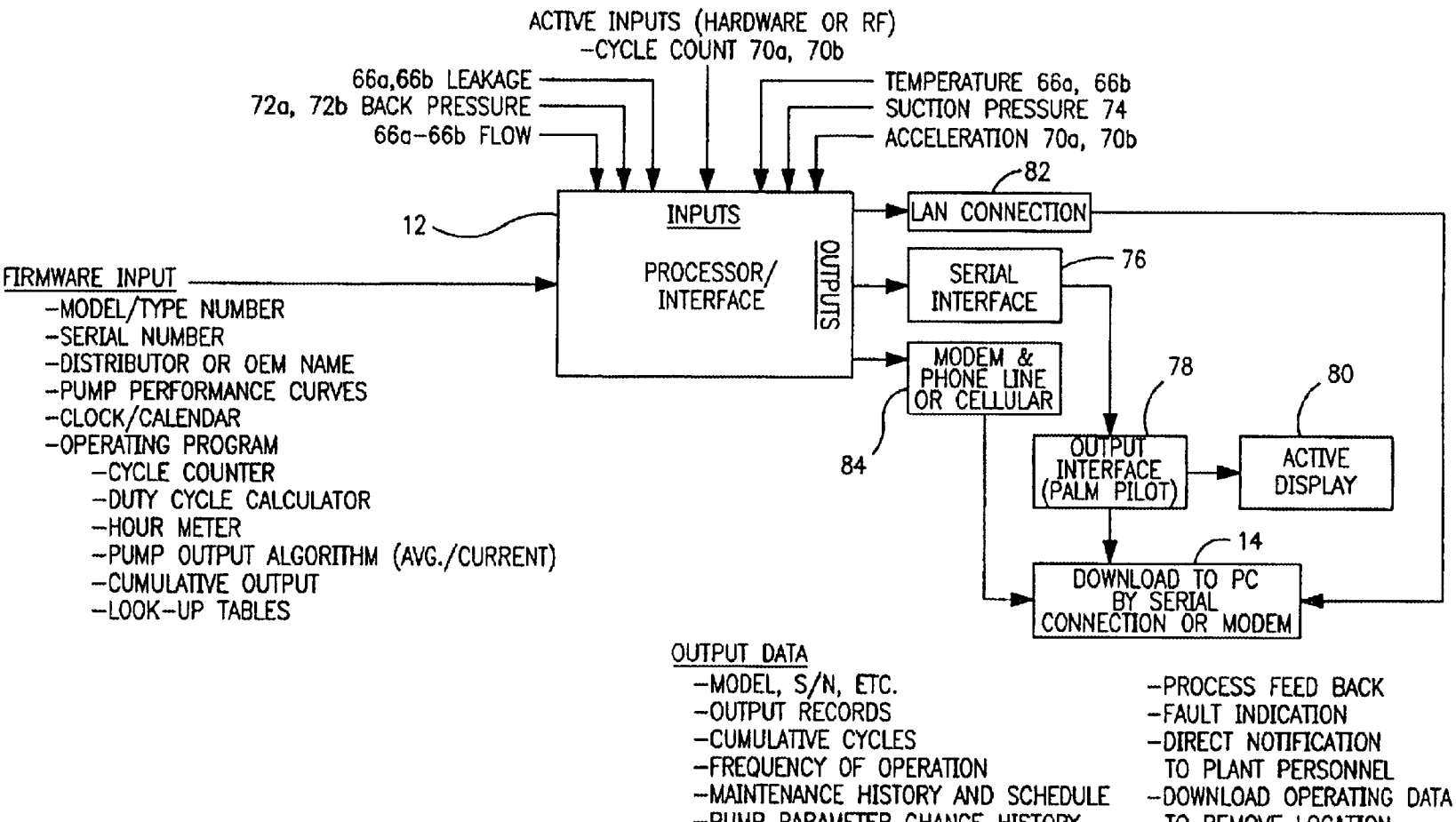
FIG. 4 illustrates an alternative embodiment of a processor associated with a pump equipped with the present invention including data communicated to the processor by sensors associated with the pump and the transmission of data from the processor to a hand held computer, active display and central computer.

The processor 12 includes a variety of data initially installed in its memory. Referring to FIGS. 3 and 4, the firm ware input of the processors 12 may include, but is not limited to the model number of the pump, the serial number, the distributor or original equipment manufacturer name, the date of manufacture, the pump performance curves, a clock or calendar and an operating program including a cycle counter, a duty cycle calculator, an hour meter, a pump output algorithm including an average output and current output, a cumulative output and lookup tables for wear parts.

FIGS. 3 and 4 indicate some of the sensor inputs discussed above with respect to FIG. 1. Specifically, a cycle count from the proximity switches or sensors 70*a*, 70*b*, leakage from diaphragm sensors 66*a*, 66*b*, flow rate into the chambers 32, 34 by way of the sensors 68*a*, 68*b* or slip flow rate through any of the check valves 28, 20, 48, 40 by way of the sensors shown at 68*a*–68*d*, acceleration of the pump or increase in the cycle rate of the pump by way of the proximity sensors 70*a*, 70*b*, back pressure by way of the sensors 72*a*, 72*b* or suction pressure by way of the sensor 74. Other possible inputs will be apparent to those skilled in the art that are too numerous to mention here.

The processor 12, which will be conventionally attached or mounted to the pump 10, can be linked to the central computer or controller 14 by a variety of means, some of which are illustrated in FIGS. 3 and 4. A serial interface 76 or infrared coupler may be employed to link the processor 12 to a hand held computer 78 which provides the operator with an active display 80. The serial interface 76 or infrared coupler may either directly, or indirectly through the hand held computer 78, link the processor 12 to the central computer 14. Further, a LAN connection 82 or a modem 84 may be employed. Another option not shown is the incorporation of a databus. Output data may include, but is not limited to, model and serial number for identification, cumulative pump output records, cumulative cycle counts, frequency of operation, maintenance history and schedule, a history of parameter changes, process feedback data, fault indication, a means for notifying the operator of significant changes or fault conditions and the ability to download operating data to a remote location or over the Internet.

Figure 2:
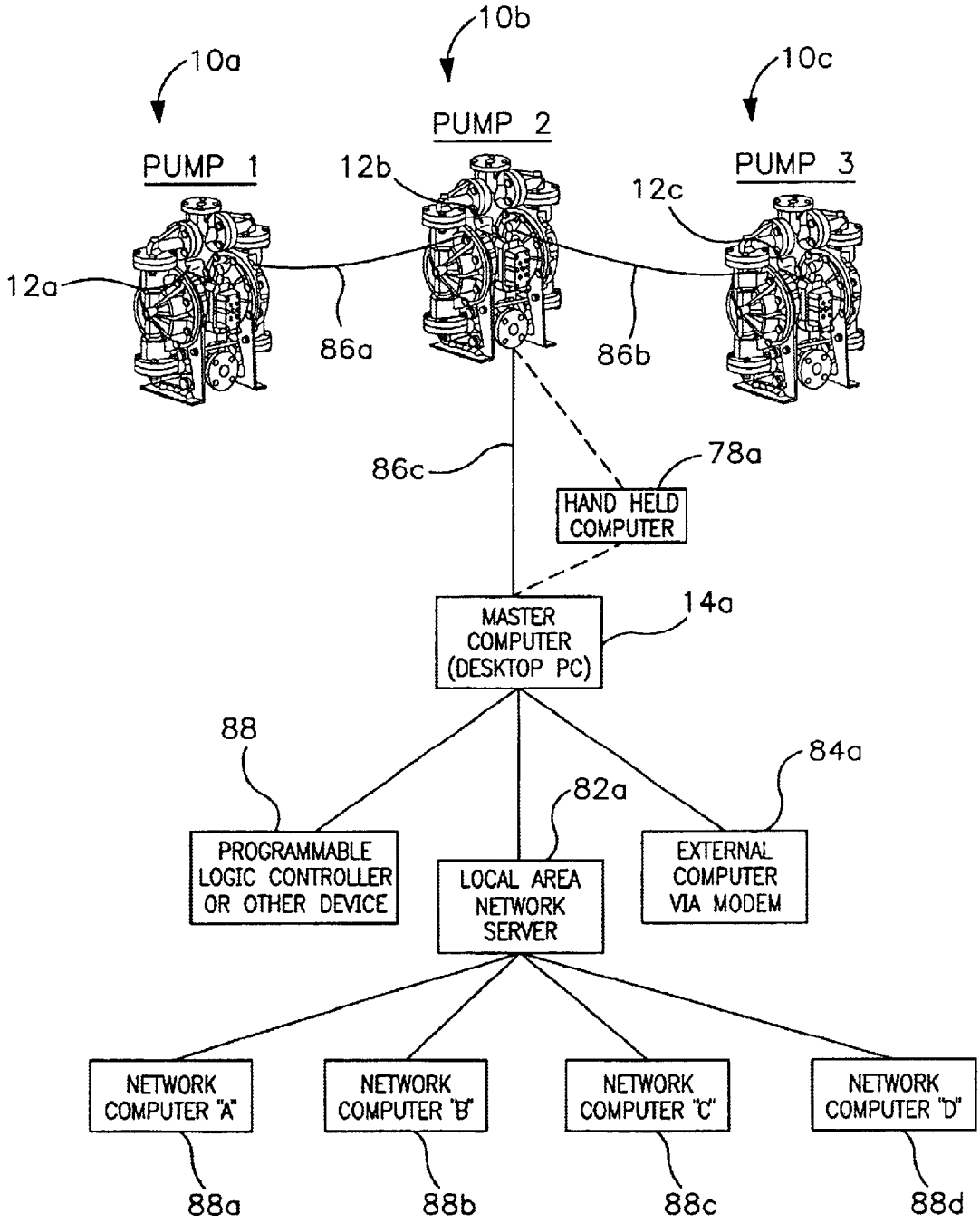
FIG. 2 is a schematic diaphragm illustrating the linking of three air operated double diaphragm pumps to a hand held computer and/or central computer which, in turn, is linked to a separate controller, local area network server or external computer by way of a modem and telephone or cellular telephone or radio frequency connection.

Further, referring to FIG. 2, a plurality of pumps 10*a*–10*c* each equipped with processors 12*a*–12*c* and one or more sensors as discussed above with respect to FIG. 1 may be linked together by way of a databus 86*a*–86*c*. In the alternative, a hand held computer 78*a* may be employed to link the pumps 10*a*–10*c* to the central computer 14*a*. The hand held computer 78*a* may also be used as a remote display or as a means for programming the operation of the pump in addition to being a link to the main computer or processor 12. Data from the central computer 14*a* may be transmitted to other local or remote devices such as a programmable logic controller 88, a LAN 82*a* or a modem 84*a*. The LAN 82*a* may also be linked to a plurality of other network computers 88*a*–88*d*.

Figures 5A, 5B:
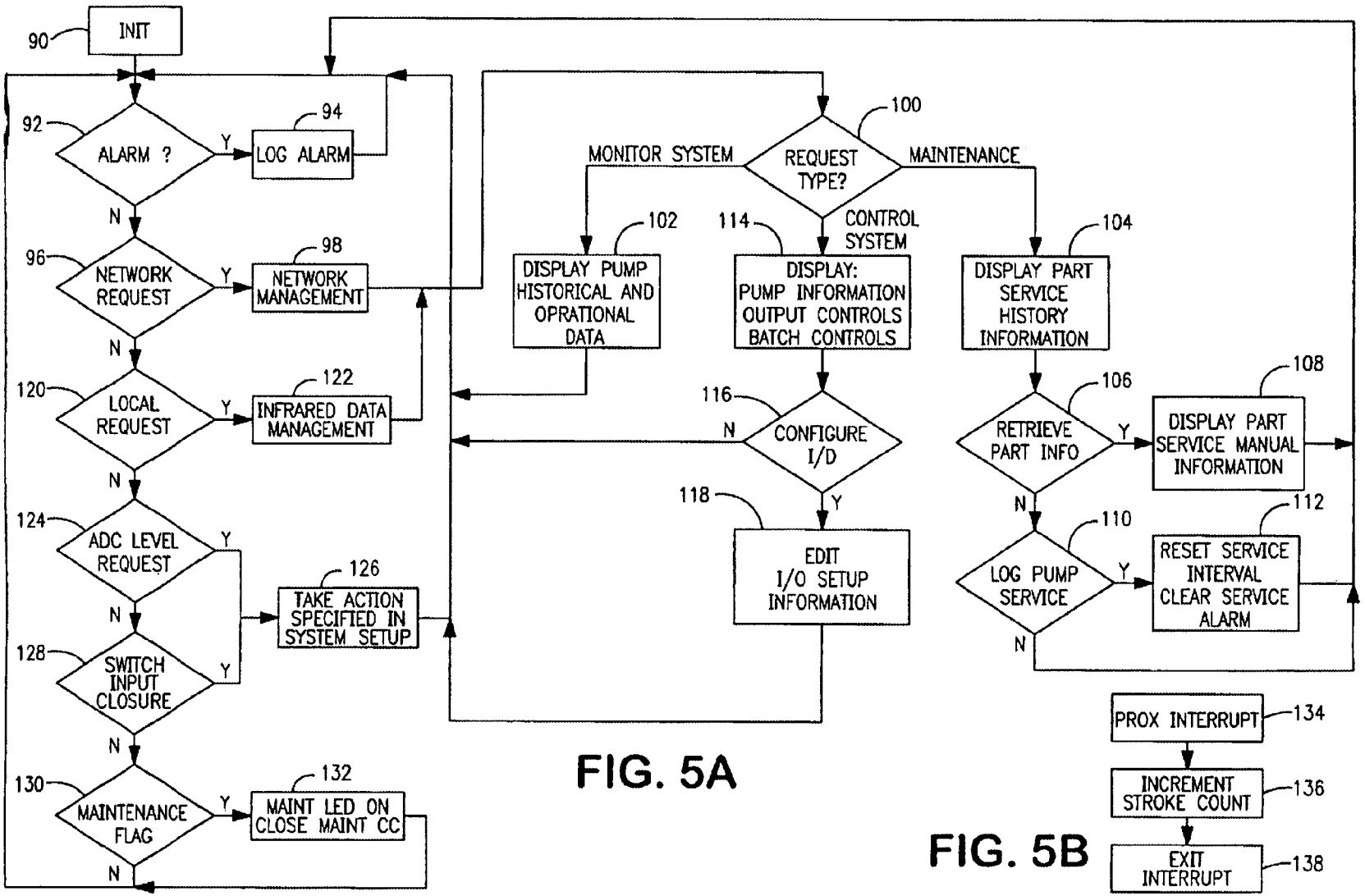
FIG. 5A illustrates schematically one flowchart for a computer program installed on a processor associated with a pump equipped with the present invention for carrying out a method according to the present invention.
FIG. 5B illustrates a flowchart for a program for counting strokes or cycles of a pump carried out at any point in the flowchart illustrated in FIG. 5A.

FIGS. 5A and 5B illustrate one software embodiment for the processor 12. An initialized step is shown at 90 prior to the step 92 where the processor checks to see whether an alarm condition has been indicated. If an alarm has been indicated, it is logged or stored into the memory at 94. An alarm can be an indication that a detector or sensor associated with a wear part or a particular operating condition is generating a signal that is out of tolerance. For example, the wear of a diaphragm may generate a signal indicating that the diaphragm is in need of replacement. Further, an alarm can indicate the failure of such a diaphragm. Similar alarms can be generated for the check valves. Still further, an alarm can be generated when reverse flow through a check valve is detected, when the output flow rate of the pump falls outside of the predetermined appropriate output range, when the cycle rate of the pump falls outside of a predetermined acceptable range, when an unacceptable acceleration of the cycle rate of the pump is detected, when an unacceptable back pressure associated with the air chambers is detected, when an unacceptable filling rate for either pumping chamber is detected, when an unacceptable suction pressure for the pump is detected or when an unacceptable temperature is detected such as a temperature of a pumping element of diaphragm. Detection of imminent or actual diaphragm failure is a more likely embodiment than diaphragm temperature measurements.

In the event no alarm condition is indicated, the processor checks to see if any request for information has been made at 96. If a network request has been made, the program is interrupted at 98 and the type of request is determined at 100. If it is a "monitor" request, the processor displays the pump historical and operational data at 102.

If it is a "maintenance" request, the processor 12 displays the part service history information at 104. If it is determined that a specific part needs service or maintenance, the part information is retrieved at 106 and the part service manual information is displayed at 108. If it is determined that a part does not need to be replaced and some other type of maintenance needs to be performed, the maintenance service is logged at 110 and the service interval is reset at 112.

If the request at 100 is a "control system" request, the pump information relating to output and batch control information is displayed at 114. If a parameter is changed, a signal may be directly transmitted to the pump at 116 or the signal may need to be reconfigured at 118 prior to the transmission of the signal to the pump.

If no network request is made at 196, the processor checks if a local request is made at 120 or a request from the hand held computer 78. If such a request is made, the request, which may typically be transmitted by way of infrared transmission, is processed at 122 before the type of request is determined at 100. If no local request has been made, and the signal is an analog signal, the signal is processed by an analog digital converted at 124 and the appropriate action is carried out at 126. If the signal is a digital signal, the signal is processed at 128 and the appropriate action is carried out at 126. A maintenance check is performed at 130 and, if a maintenance step is due, the visual indication is made at 132. As seen in FIG. 5A, the program is an endless loop.

In FIG. 5B, each proximity sensor count is registered at 134 and the program illustrated in FIG. 5A can be interrupted at any point. The count is logged at 136 and the program illustrated in FIG. 5A returns to its next sequential step at the exit interrupt step at 138.

It will be noted that the software program illustrated in FIGS. 5A and 5B is but one embodiment that can be utilized to carry out the method of the present invention. As shown above in FIG. 1, a variety of sensor inputs can be utilized and as shown in FIG. 24, a variety of means for transmitting information from the pump processors to a main computer can be employed. Further, a variety of input and output information can be utilized.

Further, additional sensors may be employed for monitoring and detecting changes in the pump's unique signatures, such as acoustic or vibratory signatures.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A method of facilitating maintenance of a pump comprising the following steps:

providing a pump including wear parts, a processor and memory;

sensing at least one longitudinal wave generating operating behavior of the pump indicative of the operation of the pump;

generating operational data reflective of the sensed operating behavior;

storing the generated operational data in the memory;

storing parts identification data identifying wear parts of the pump in the memory;

storing at least one predetermined level of operational information;

operating the processor to compare the stored predetermined level to the stored operational data and in dependent response thereto outputting information as to the desirability of replacing or repairing at least one selected wear part.

2. The method of claim 1 further comprising the following step:

repeating the step of sensing one longitudinal wave generating operating condition of the pump indicative of the operation of the pump, generating operational data reflective of the sensed operating condition, storing the operational data in the memory, and thereafter updating the stored operational data in dependent response to the sensing of the at least one operating condition.

3. The method of claim 1 further comprising the following steps:

retrieving parts identification data for the at least one selected part from the memory, and outputting information identifying the at least one part whose replacement or repair is desired.

4. The method of claim 1 wherein the pump comprises a pumping element and the structural operational behavior of the sensing step is a physical integrity of the pumping element of the pump.

5. The method of claim 1 further comprising the following step:

providing at least one sensor.

6. The method of claim 1 wherein the pump comprises a pumping element and the structural operational behavior of the sensing step is a temperature of the pumping element of the pump.

7. The method of claim 2 wherein the pump comprises a check valve and the operational condition of the sensing step is a reverse fluid flow through the check valve.

8. The method of claim 4 wherein the pumping element is a diaphragm.

9. The method of claim 6 wherein the pumping element is a diaphragm.

10. The method of claim 2 further comprising the following step:

operating the processor to compare the stored predetermined level to the stored operational data and in dependent response thereto outputting information as to the desirability of modifying the operation of pump.

11. The method of claim 10 wherein the operational condition of the sensing step is an output flow rate of the pump.

12. The method of claim 10 wherein the operational condition of the sensing step is a cycle rate of the pump.

13. The method of claim 10 wherein the operational condition of the sensing step is an acceleration of a cycle rate of the pump.

14. The method of claim 10, wherein the pump is an air operated diaphragm pump comprising an air chamber and the operational condition of the sensing step is a back pressure in the air chamber.

15. The method of claim 10, wherein the pump comprises at least one pumping chamber and the operational condition of the sensing step is filling rate of the pumping chamber.

16. The method of claim 10, wherein the operational condition of the sensing step is a suction pressure of the pump.

17. A method of modifying an operation of a pump comprising the following steps:

providing a pump, a processor and memory;

sensing at least one acoustical signal generating operating condition of the pump indicative of the operation of the pump with an acoustical signature sensor;

generating operational data reflective of the sensed operating condition;

storing the generated operational data in the memory;

storing at least one predetermined level of operational information;

operating the processor to compare the stored predetermined level to the stored operational data and in dependent response thereto outputting information as to the desirability of modifying the operation of pump.

18. The method of claim 17 further comprising the following step:

repeating the steps of sensing at least one operating condition of the pump indicative of the operation of the pump;

generating operational data reflective of the sensed operating condition, storing the operational data in the memory, and thereafter updating the stored operational data in dependent response to the sensing of the at least one operating condition.

19. The method of claim 17 wherein the pumping element is a diaphragm.

20. The method of claim 18 wherein the operational condition of the sensing step is an output flow rate of the pump.

21. The method of claim 18 wherein the operational condition of the sensing step is an acceleration of a cycle rate of the pump.

22. The method of claim 18 wherein the pump comprises a pumping element and the operational condition of the sensing step is a temperature of the pumping element of the pump.

23. The method of claim 18 wherein the pump is an air operated diaphragm pump comprising an air chamber and the operational condition of the sensing step is a back pressure in the air chamber.

24. The method of claim 18 wherein the pump comprises at least one pumping chamber and the operational condition of the sensing step is a filling rate of the pumping chamber.

25. The method of claim 18 wherein the operational condition of the sensing step is a suction pressure of the pump.

26. The method of claim 18 wherein the pump comprises wear parts and the method further comprises the following steps:

storing parts identification data identifying wear parts of the pump in the memory; and operating the processor to compare the stored predetermined level to the stored operational data and in dependent response thereto outputting information as to the desirability of replacing or repairing at least one selected wear part.

27. The method of claim 18 wherein the operational condition of the sensing step is a cycle rate of the pump.

28. The method of claim 26 wherein the at least one wear part is a pumping element and the operational condition of the sensing step is a physical integrity of the pumping element.

29. The method of claim 28 wherein the pumping element is a diaphragm.

30. The method of claim 26 wherein the at least one wear part is a check valve and the operational condition of the sensing step is a reverse fluid flow through the check valve.

31. A pump comprising:

at least one wear part, a processor and memory, at least one acoustical sensor for sensing at least one operating condition of the pump, and a display, the acoustical sensor communicating operational data reflective of the sensed operating condition to the processor, the processor storing the operational data in the memory and updating the stored operational data upon receipt of new operational data from the sensor, the memory also comprising parts identification data identifying wear parts of the pump and at least one predetermined level of operational information, the processing comparing the stored predetermined level to the stored operational data and in dependent response thereto outputting information to the display as to the desirability of replacing or repairing at least one selected wear part.

32. The pump of claim 31 wherein the processor is in communication with a stand alone computer.

33. The pump of claim 31 wherein the computer is a hand held computer.

34. The pump of claim 31 wherein the processor of the pump is linked to at least one other processor of another pump.

35. The pump of claim 31 wherein the wear part is a pumping element.

36. The pump of claim 31 wherein the wear part is a check valve and comprises a sensor that senses a reverse fluid flow through the check valve.

37. The pump of claim 31 wherein the processor further compares the stored predetermined level to the stored operational data and in dependent response thereto outputs information as to the desirability of modifying the operation of pump.

38. The pump of claim 35 wherein the pumping element is a diaphragm.

39. A pump comprising:

at least one wear part, a processor and memory, at least one sensor for sensing at least one acoustical signal generating operating condition of the pump, and a display, the sensor communicating operational data reflective of the sensed operating condition to the processor, the processor storing the operational data in the memory and updating the stored operational data upon receipt of new operational data from the sensor, the memory also comprising parts identification data identifying wear parts of the pump and at least one predetermined level of operational information, the processor comparing the stored predetermined level to the stored operational data and in dependent response thereto outputting information to the display as to the desirability of replacing or repairing at least one selected wear part modifying the operation of the pump.

40. The pump of claim 39 wherein the processor compares the stored predetermined level to the stored operational data and in dependent response thereto outputting information to the display as to the desirability of replacing or repairing at least one selected wear part.

41. A method of facilitating maintenance of a pump comprising the following steps:

providing a pump including wear parts, a processor and memory;

sensing at least one acoustic signature signal of the pump indicative of the operation of the pump;

storing the sensed signature signal in the memory;

storing parts identification data identifying wear parts of the pump in the memory;

storing at least one predetermined signature signal;

operating the processor to compare the stored predetermined signature signal to the stored sensed signature signal and in dependent response thereto outputting information as to the desirability of replacing or repairing at least one selected wear part.

42. The method of claim 41 wherein the signature signal is a vibratory signal.

43. A pump comprising:

at least one wear part, a processor and memory, at least one sensor for sensing at least one acoustical signature signal of the pump, and a display, the sensor communicating the sensed signature signal to the processor, the processor storing the signature signal in the memory and updating the stored signature signal upon receipt of a new signature signal from the sensor, the memory also comprising parts identification data identifying wear parts of the pump at least one predetermined signature signal, the processor comparing the stored predetermined signature signal to the stored signature signal and in dependent response thereto outputting information to the display as to the desirability of replacing and repairing at least one selected wear part.

44. The pump of claim 43 wherein the signature signal is a vibratory signal.

* * * * *